United States Patent [19]

Luker et al.

[11] 4,288,000

[45] Sep. 8, 1981

[54] CHILD-RESISTANT LID FOR A PAIL

[75] Inventors: Charles E. Luker; Peter P. Gach, both of Evansville, Ind.

[73] Assignee: Sunbeam Plastics Corporation, Evansville, Ind.

[21] Appl. No.: 174,736

[22] Filed: Aug. 4, 1980

[51] Int. Cl.[3] ..... B65D 43/04

[52] U.S. Cl. ..... 220/281; 220/254; 220/288; 220/306; 206/508

[58] Field of Search ..... 220/254, 281, 306, 288; 206/508, 509; 215/216, 218

[56] References Cited

U.S. PATENT DOCUMENTS

| | | | |
|---|---|---|---|
| 3,307,739 | 3/1967 | Cloyd et al. | 206/508 |
| 3,519,163 | 7/1970 | Bardell | 206/508 X |
| 3,989,152 | 11/1976 | Julian | 215/216 |
| 4,000,839 | 1/1977 | Tecco et al. | 220/254 X |
| 4,165,020 | 8/1979 | Hoselton | 206/306 |

*Primary Examiner*—George T. Hall

*Attorney, Agent, or Firm*—Fisher, Gerhardt, Crampton & Groh

[57] ABSTRACT

A tightly fitting lid for a pail or bucket has a dispensing opening for discharge of the material contained in the pail and a child-resistant closure for the opening. The lid and pail constitute a package for particulate material. The lid and pail have co-operating rib and recess for retaining the lid on the pail. The lid opening is provided by a short "wide-mouth" neck which is threaded to mate with threads on the closure. The lid and closure have at least one interengaging stop and lug, respectively, which prevent the closure from being unscrewed. The closure can be removed after it is radially deformed in order to disengage the lug from the stop. The diameter of the closure is such that the closure lug cannot be disengaged from the stop by a child of tender years whose hand is too small to span the closure. The lid also has a plurality of horizontally extending webs surrounding and spaced from the closure for supporting a superposed pail.

10 Claims, 3 Drawing Figures

FIG. 1
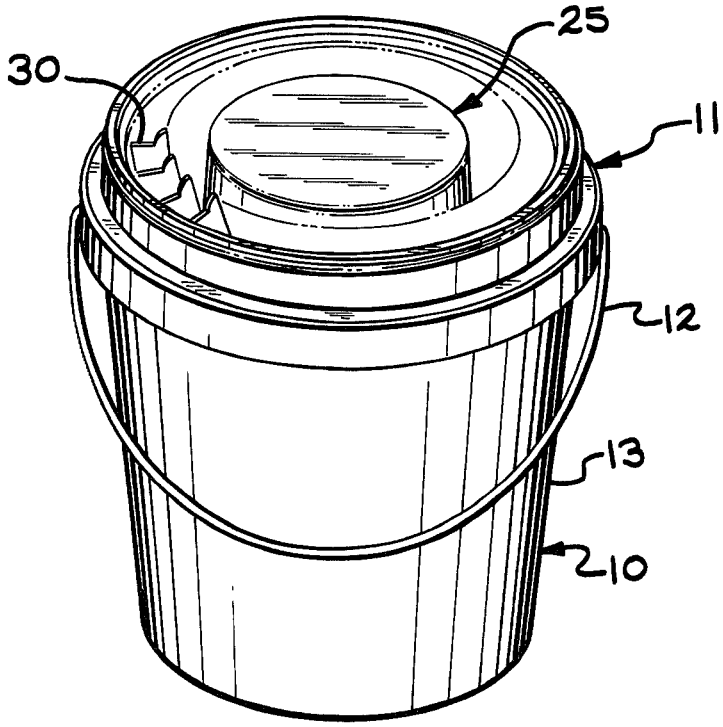
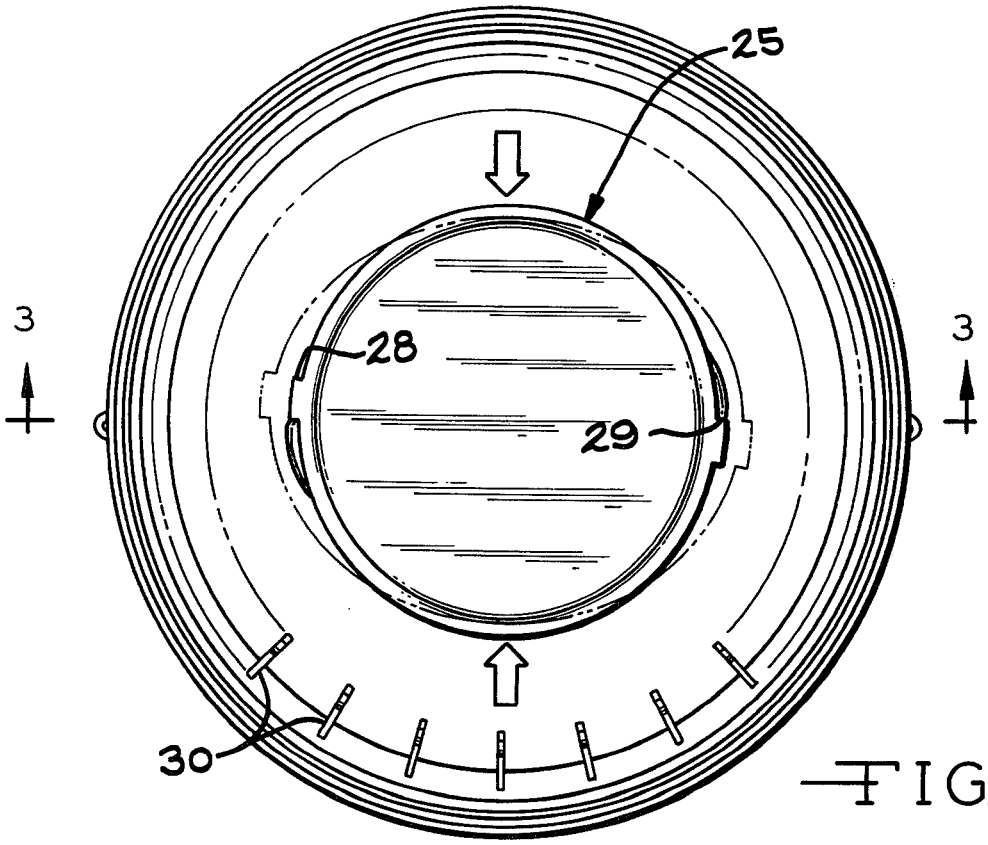
FIG. 2

CHILD-RESISTANT LID FOR A PAIL

BACKGROUND OF THE INVENTION

Many potentially harmful materials, such as swimming pool chemicals, are packaged and sold to the public in pails or buckets of two, five or ten gallon capacities. As a result, buckets containing these material often are kept in the household of the person who has the swimming pool where small children may be able to gain access to the contents with harmful results. Some of the swimming pool chemicals are provided in large pellets, say two or three inches in size, so that any lid for a pail containing such materials must be readily removable or must have a "wide-mouth" opening through which the large pellets or tablets can be dispensed. In such a case it is relatively easy for a small child to gain access to the dangerous contents. Other chemicals are provided in granular or powdered form and are equally dangerous to small children.

Packages for dangerous particulate chemicals consisting of pails with lids thereon previously have been suggested and, in some cases, the lids and pails are so designed that it is almost impossible to remove a lid from a pail. In these cases some kind of dispensing opening must be provided so that the householder can dispense the content material.

In addition, packages of this general type must meet the requirements of several governmental agencies such as the Federal Department of Transportation which tests the packages severely to be certain that if such a package is dropped it will not burst open. Additionally, the Consumer Products Safety Commmision examines packages for dangerous chemicals so as to be certain that the actual purchaser or consumer of the product is protected to the greatest possible extent. The Environmental Protection Agency also considers these packages to make certain that they comply with the rules of that organization.

It is, therefore, the principal object of the instant invention to provide a package for harmful particulate materials consisting of a pail and a lid for the pail that is very tightly retained on the pail so as to be difficult if not impossible to remove, the lid having a "wide-mouth" dispensing opening so as to permit the dispensing of large chemical pellets and the opening having a child-resistant closure so that a small child cannot gain access to the contents of the package.

From another standpoint, the instant invention has as its object the provision of a child-resistant lid for a pail, the pail being intended to contain dangerous particulate material.

BRIEF DESCRIPTION OF THE DRAWINGS

FIG. 1 is a view in perspective of a pail and lid embodying the invention;

FIG. 2 is a plan view of a lid according to the invention, shown on an enlarged scale and illustrating how the child-resistant closure may be opened by an older child or an adult having relatively larger hands and greater strength than a child of tender years, say 6 or 7 years of age.

DESCRIPTION OF PREFERRED EMBODIMENT

Figure 3:
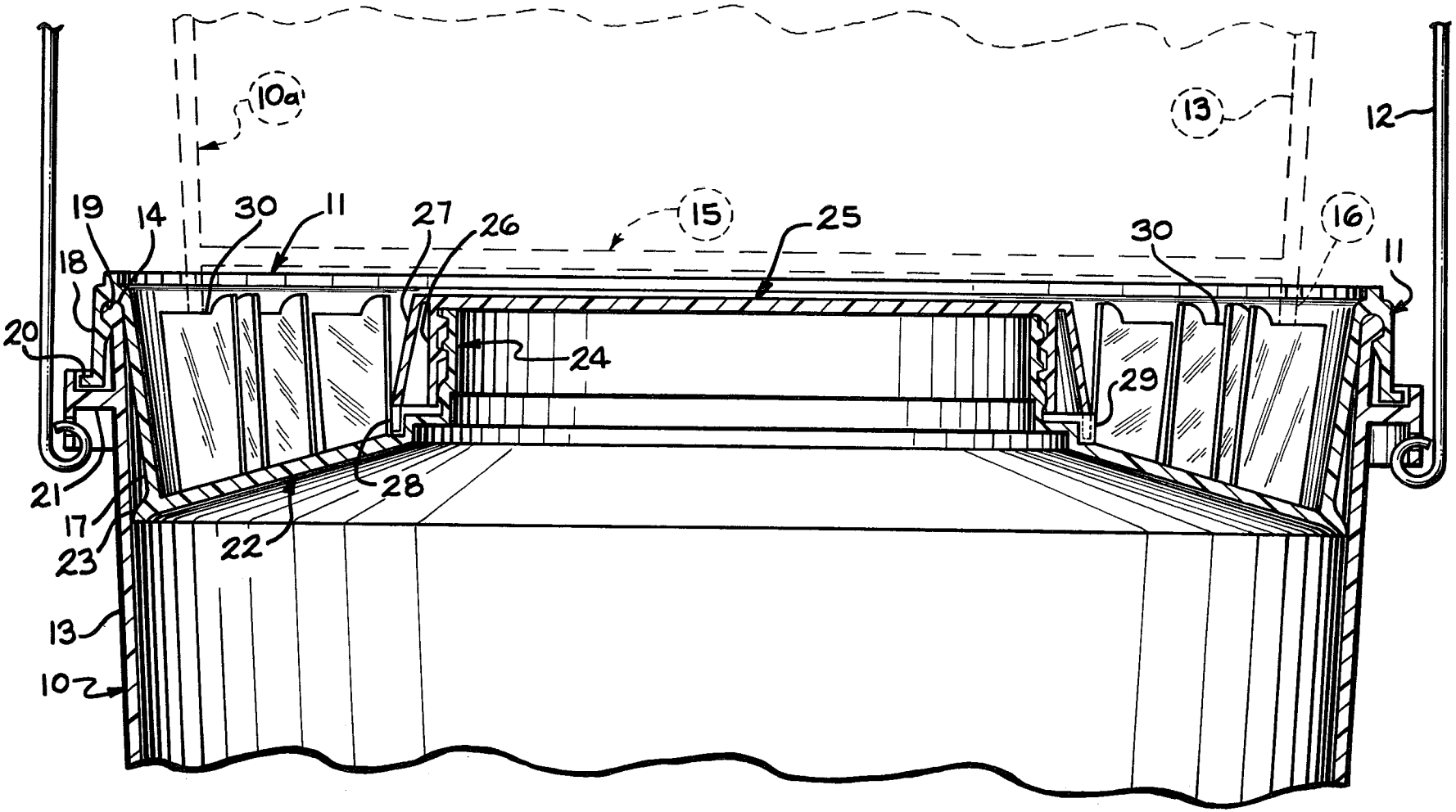
FIG. 3 is a fragmentary, vertical sectional view taken along the line 3—3 of FIG. 2 and shown on a greatly enlarged scale with a portion of the bottom part of an additional package illustrated in superposed position as would be the case in storage and/or shipment of packages of this general type.

A package embodying the invention consists of a pail 10 and a lid 11 which have co-operating means so that after assembly, as illustrated in FIG. 1, they provide a sturdy, child-resistant container for potentially harmful particulate materials such as swimming pool chemicals. The lid 11 has suitable apertures for the engagement of a conventional bail 12.

The pail 10 has a generally frusto-conical side wall 13, terminating in a circular rim bead 14 and a bottom 15 of diameter less than the rim 14 at the edge of which there is located an axially extending flange 16.

The lid 11 has a pair of radially spaced, concentric skirts which are an inner skirt 17 and an outer skirt 18. The two skirts 17 and 18 depend from the periphery of the lid 11 and their opposed inner surfaces near their junction define an annular groove 19 into which the pail bead 14 snaps when the lid 11 is pushed down onto the pail 10 in the position shown in FIG. 3. The outer skirt 18 extends downwardly, terminating in an outwardly directed lip 20 which nests in an annular ledge 21 extending around the outside of the pail 10. The nesting of the lip 20 and ledge 21 makes it almost impossible to remove the lid 11 from the pail 10 even by the use of an instrument such as a screwdriver or the like.

The inner skirt 17 extends downwardly into the interior of the pail 10. A dome-shaped lid body 22 is integrally connected at the lower end of the skirt 17 and has an outwardly extending rim 23 which fits tightly against the inner wall of the pail 10. An upwardly extending "wide-mouth" neck 24 is integrally located at the center of the lid body 22 and extends upwardly therefrom only to a level beneath the level of the upper junction between the inner and outer skirts 17 and 18. The outer side of the neck 24 is threaded for the reception of a removable child-resistant closure 25.

The closure 25 has an inner threaded skirt 26 which mates with the threads on the neck 24 and an outer, concentric, flexible skirt 27. The outer skirt 27 has at least one depending lug 28 which normally engages a cooperating stop 29 located on the lid body 22 adjacent the neck 24 so as to prevent unscrewing of the closure 25 from the closed position illustrated in FIG. 2. When an adult or an older child desires to gain access to the contents of the package, he squeezes the outer skirt 27 of the closure 25 in the direction indicated by the arrows in FIG. 2, flexing the outer skirt 27 to move the lug or lugs 28 radially outwardly so that they clear the stop or stops 29 as shown in broken lines in FIG. 2 whereupon the closure 25 may be unscrewed from the neck 24. It will be appreciated that because of the "wide-mouth" configuration of the neck 24 and the closure 25, the hand of a child of tender years, say five or six, is not large enough to span the outer closure skirt 27 thus to squeeze it inwardly to radially deflect the lug 28 in order to enable the closure 25 to be unscrewed. Because the lid 11 is so tightly retained on the pail 10, as described, a package embodying the invention is almost perfectly child-resistant and safely can be stored in the home.

A lid according to the invention also has a circumferentially extending series of horizontal spacers 30 extending inwardly from the inner lid skirt 17 into the annular space between the lid skirt 17 and the outer skirt 27 of the closure 25. The upper edges of the spacers 30 are located at a level so that when a second pail, shown in broken lines in FIG. 3 and indicated by the reference number 10*a*, is superposed on a package according to the invention, its downwardly extending flange 16 rests on the spacers 30 and its bottom 15 does not contact any part of the closure 25. The provision of the spacers 30 thus permits packages according to the invention to be stacked one on top of the other in storage and/or shipment lessening the space thus required.

Having described our invention we claim:

1. A lid for a pail or bucket, said lid and the rim of said pail having co-operating snap-over means for retaining said lid on said pail, said lid having (a) a short, centrally located neck, (b) an annular body, integral with and surrounding said neck, (c) an inner annular skirt at the periphery of said body and extending upwardly therefrom to a level above the top of said neck, (d) a rim at the junction on said body and said inner skirt that is adapted to tightly fit the inner surface of the pail, (e) an outer annular skirt depending from the upper end of said inner skirt which is adapted to fit circumjacently to the outer side of the pail, (f) a removable closure for said neck, and (g) co-operating, disengageable child-resistant means on said body near said neck and on said closure.

2. A lid for a pail according to claim 1 in which the closure has a deformable skirt which extends concentrically around the neck and the child-resistant means comprise an opposed lug and stop on said skirt and the container body adjacent said neck which are disengageable by outwardly deforming a portion of said closure skirt.

3. A lid for a pail according to claim 1 and a circumferentially extending series of spacers on the lid body located between the neck and the inner skirt and which extend upwardly a distance sufficient for supporting a superposed pail with no contact between the superposed pail and the closure.

4. A lid for a pail or bucket, said lid having (a) an outermost annular skirt adapted to fit circumjacently of the rim of said pail, (b) an inner skirt which depends from the upper edge of said outer skirt and which has an annular sealing lip at its lower margin, said lip fitting tightly against the inner surface of said pail, (c) a disc-like body extending across said lid at the lower margin of said inner skirt, (d) a threaded neck centrally located in said body and extending upwardly to a level below the level of the upper edge of said outer skirt, (e) a cup-shaped closure for said neck, said closure having radially spaced, concentric inner and outer skirts, (f) co-operating means on said neck and the inner side of said inner skirt of said closure for retaining said closure on said neck, and (g) co-operating child-resistant means on said outer skirt of said closure and on said lid adjacent the outer side of said neck for normally preventing the removal of said closure from closed position, said outer skirt being radially deformable for disengaging said child-resistant means.

5. A lid according to claim 4 and a circumferential recess at the inner side of the junction of the inner and outer lid skirts for the reception and retention of a pail rim bead.

6. A package for dry, particulate material, said package consisting of (a) a pail having a frusto-conical body, a circular bottom which has an axially extending, annular flange around its periphery and a circular top rim of diameter larger than the diameter of said flange, (b) a circular lid for said pail, said lid having (1) radially spaced, concentric inner and outer skirts joined at their upper ends, said outer skirt fitting closely circumjacent said rim and the peripheral edge of said inner skirt fitting tightly against the inner surface of said pail body below said rim, (2) an annular body extending inwardly from the lower portion of said inner skirt, (3) a centrally located, threaded neck of diameter less than the diameter of said inner skirt, and (4) a series of horizontal spacers on said body and extending around said neck for supporting a superposed pail, and (c) a threaded closure for said neck, said lid and said pail rim having inter-fitting snap-over means for retaining said lid on said pail.

7. A package according to claim 6 in which the snap-over means is a rim bead on the pail and a circular recess for said bead in the inner side of the junction of the inner and outer skirts of the lid.

8. A package according to claim 6 in which the junction of the outer and inner lid skirts is at a level above the level of the spacers and the spacers are at a level for supporting a superposed package out of contact with the closure.

9. A package according to claim 6 and disengageable child-resistant means on the closure and the lid adjacent the neck.

10. A package according to claim 9 in which the closure has an inner threaded skirt and a flexible outer skirt concentric with said inner skirt and the child-resistant means are co-operating lug and stop on said outer closure skirt and on the lid adjacent the neck.

* * * * *